US007399194B1

(12) United States Patent
Gilliam

(10) Patent No.: US 7,399,194 B1
(45) Date of Patent: Jul. 15, 2008

(54) ELECTRIC CONNECTOR

(76) Inventor: Charles David Gilliam, 19423 Indian Ridge Ave., Baton Rouge, LA (US) 70817

( * ) Notice: Subject to any disclaimer, the term of this patent is extended or adjusted under 35 U.S.C. 154(b) by 0 days.

(21) Appl. No.: 11/801,627

(22) Filed: May 10, 2007

(51) Int. Cl.
*H01R 13/15* (2006.01)

(52) U.S. Cl. ..... 439/263; 439/564; 439/805

(58) Field of Classification Search ..... 439/230, 439/564, 766, 778, 779, 784, 805
See application file for complete search history.

(56) References Cited

U.S. PATENT DOCUMENTS

| | | | | | |
|---|---|---|---|---|---|
| 1,667,485 | A * | 4/1928 | MacDonald | 439/836 |
| 2,567,727 | A * | 9/1951 | Quackenbush | 439/837 |
| 3,036,839 | A * | 5/1962 | Williamson, Jr. | 279/24 |
| 3,493,917 | A * | 2/1970 | Glowacz | 439/268 |
| 3,798,586 | A * | 3/1974 | Huska | 439/263 |
| 3,824,556 | A * | 7/1974 | Berkovits et al. | 439/727 |
| 4,427,252 | A * | 1/1984 | Lee et al. | 439/320 |
| 4,443,054 | A * | 4/1984 | Ezawa et al. | 439/263 |
| 4,525,014 | A * | 6/1985 | Holman et al. | 439/92 |
| 5,161,534 | A * | 11/1992 | Berthiaume | 600/434 |
| 5,167,476 | A * | 12/1992 | Lafferty et al. | 408/240 |
| 5,219,304 | A * | 6/1993 | Lin | 439/461 |
| 5,621,181 | A * | 4/1997 | Waterman | 73/866.5 |
| 5,752,706 | A * | 5/1998 | Hodges | 279/16 |
| 5,938,212 | A * | 8/1999 | Wadsworth | 279/42 |
| 7,175,184 | B1 * | 2/2007 | Rinner et al. | 279/43 |
| 2005/0218132 | A1 * | 10/2005 | Wells | 219/137.61 |
| 2007/0123860 | A1 * | 5/2007 | Francis et al. | 606/61 |
| 2007/0220731 | A1 * | 9/2007 | Soroka et al. | 29/447 |

OTHER PUBLICATIONS

Roland S. Timsit, "Electrical Contact Resistance: Properties of Stationary Interfaces," IEEE Transactions on Components & Packaging Technology, vol. 22, No. 1, Mar. 1999, p. 85-98.

* cited by examiner

*Primary Examiner*—Ross N Gushi
(74) *Attorney, Agent, or Firm*—Roy, Kiesel, et al.

(57) ABSTRACT

An improved single-pole electrical connector is disclosed. The connector has a base electrical connection at one end and a pin-and-collet type electrical connection at the other end. A nonconductive mounting base is used to attach the connector to an electrical distribution panel. An electrical cable (e.g., an electrical supply line) is connected to the base electrical connection. Another electrical cable (e.g., from an electrical load) is connected to a pin, which is inserted into the collet. A collet nut is tightened to provide a secure electrical and mechanical connection between the pin and collet. The nonconductive mounting base provides a secure attachment to the distribution panel and insulates the electrically conductive parts of the connector from the panel. An insulating boot may be used to cover the pin and collet side of the connector in use.

20 Claims, 4 Drawing Sheets

ELECTRIC CONNECTOR

FIELD OF THE INVENTION

The invention relates generally to a single-pole electrical power connector, and more particularly, to a single-pole electrical connector used in oilfield applications.

BACKGROUND AND SUMMARY OF THE INVENTION

Oil and gas drilling rigs are located throughout the world, both on land and at sea. There are important differences between the types of drilling rigs used for inland sites compared to those used for offshore drilling. An offshore drilling rig is typically very large, and may be made as a unitary structure. The electrical power generation and distribution system can be built on an offshore rig before the rig is moved into its operating location. This allows for hardwired connections and other permanent or semi-permanent electrical connections in the electrical distribution system.

Many inland oil and gas drilling rigs are much smaller than their offshore counterparts. It is common for inland rigs to be constructed in a more modular form, with the various parts of the rig being put together at the drilling location. A rig of this type may be hauled to the drilling site on one or more trucks. Because the rig is delivered in parts and assembled on site, the electrical distribution system is often prepared on site, as well. It is not common to have an electrical power distribution system pre-wired for a smaller inland drilling rig.

The field assembly and installation of many inland drilling rigs has led to widespread use of single pole electrical connectors that can be prepared in the field. A pin and collet style single pole connector has been used on inland oil and gas drilling platforms for many years. A typical connector of this type has a threaded shaft at one end and a threaded collet at the other end. This type of connector is shown in FIG. 5. One power line, typically the input line, is connected to the threaded shaft end of the connector. A pin is connected to the end of the other electrical cable, typically the output line, and this pin is placed inside the collet. A large collet nut is then tightened to create a secure connection. Some type of insulating boot or cover is then positioned over the collet and pin portion of the connection. Another boot or cover may be used to cover the threaded shaft connection, as well.

These single pole connectors are mounted in a distribution panel. The panels are typically made of melamine, fiberglass, or some other electrically nonconductive material. Holes are drilled into the panels, and the connectors are pressed into the holes. The panel connection portion of the single pole connector is typically knurled or grooved to create a more secure fit with the distribution panel. This fit is important to the operation and use of the connectors in this harsh environment.

The connectors are usually mounted into the distribution panels before the collet and pin connection is made. This method of completing the electrical connection results in a great deal of torque applied to the connection between the connector and the distribution panel. When an oilfield worker tightens the large collet nut, the entire connector will tend to rotate. Such rotation is prevented only by the connection between the connector and the distribution panel. Because this connection is not very strong or secure, it is common to have the connector strip its connection to the distribution panel, and thus turn freely within the mounting hole in the panel. When this happens, it may be very difficult to make or unmake the pin and collet connection. In addition, when the connector strips its connection to the distribution panel, another hole in the panel must be drilled, and the connector reinstalled or a new connector installed. These failures and the necessary follow-up actions add time and cost to the overall operation.

Improvements have been made to single pole connectors to address the problem of a connector striping its connection to a distribution panel. The most common improvement is the machining of splines into the body of the connector. These splines engage the distribution panel when a connector is pressed into a hole in the panel. The splines, however, are not enough to prevent many connectors from stripping in distribution panels. Despite this problem, splined connectors of this type have been widely used in the oilfield for many years.

Another improvement consists of a set screw or key in the connector that engages a slot cut into the edge of the mounting hole in the distribution panel. This configuration creates more resistance to the torque applied when the collet nut is tightened, but it also requires additional installation time. A slot must be cut into the panel after the normal mounting hole has been drilled out. Even when this system is used, some of the connections to distribution panels will strip out.

The standard pin and collet configuration also results in a less than optimal connection. The collet nut must be tightened a great deal to provide a mechanically secure connection. If a pulling force is applied to the cable with the pin on its end, the pin may pull out of the collet, thus causing arcing and a loss of electrical connection. The arcing may create a fire risk or a direct risk to nearby personnel. To reduce the risk of pull out, workers tend to tighten the collet nuts as tight as possible. To do this, workers apply a great deal of torque to the collet nuts, which, in turn, causes more of the connectors to strip out the connections to the distribution panel. One shortcoming of this arrangement (i.e., the possibility of pin pull out) thus exacerbates another shortcoming (i.e., the stripping of the panel connection).

The threaded shaft end of these common single pole connectors also poses problems in use. A bus bar type connection is generally preferred for making a reliable, low-resistance connection. A standard lug connection may be crimped onto the end of an electrical cable, and the lug connected to the bus bar using a standard bolt and nut connection. It would be a further improvement on the common design to include a bus bar type connection on the end opposite the collet.

There is a need, therefore, for an improved single pole connector for use in the oilfield. The invention disclosed and claimed herein provides such an improvement. In one embodiment, the invention includes [insert from general claim].

DETAILED DESCRIPTION OF THE INVENTION

Figure 1A:
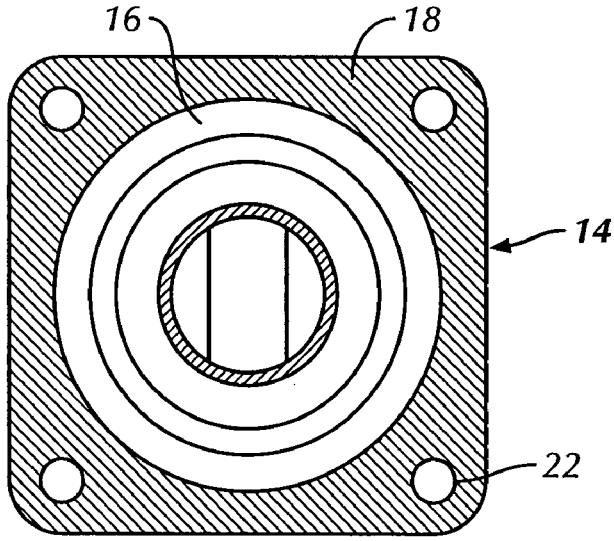
FIG. 1A is a cross-sectional view of a preferred embodiment of a single pole electrical connector according to the present invention.
Figure 1B:
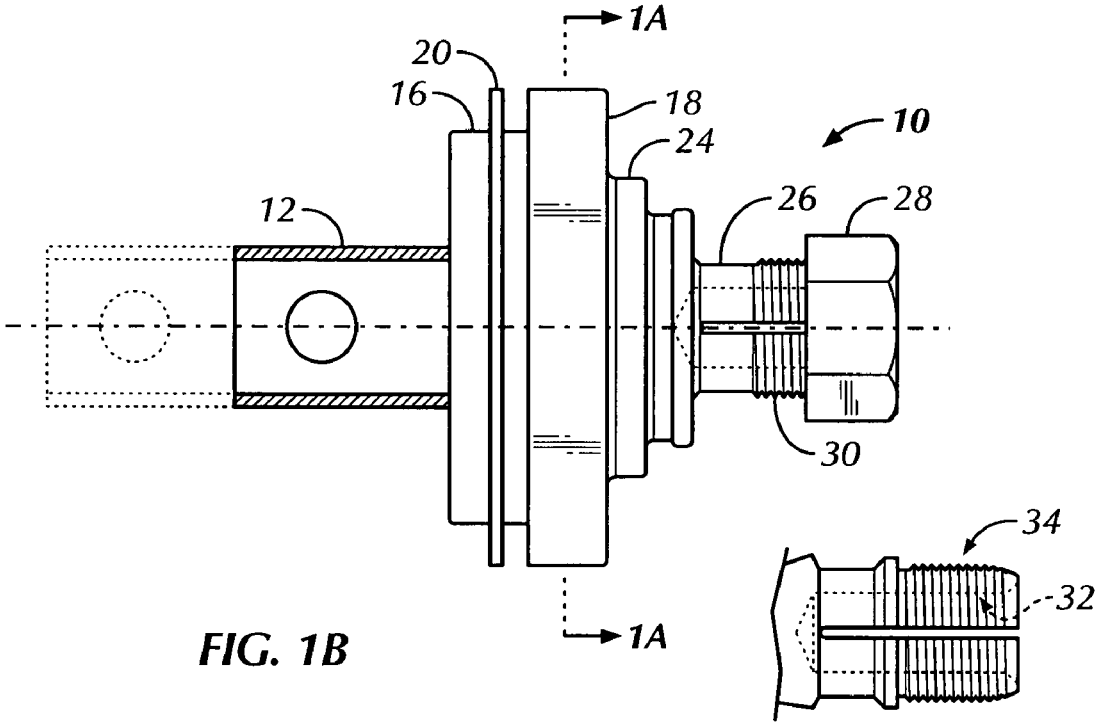
FIG. 1B is a side view of parts of a preferred embodiment of a single pole electrical connector according to the present invention.
Figure 2:
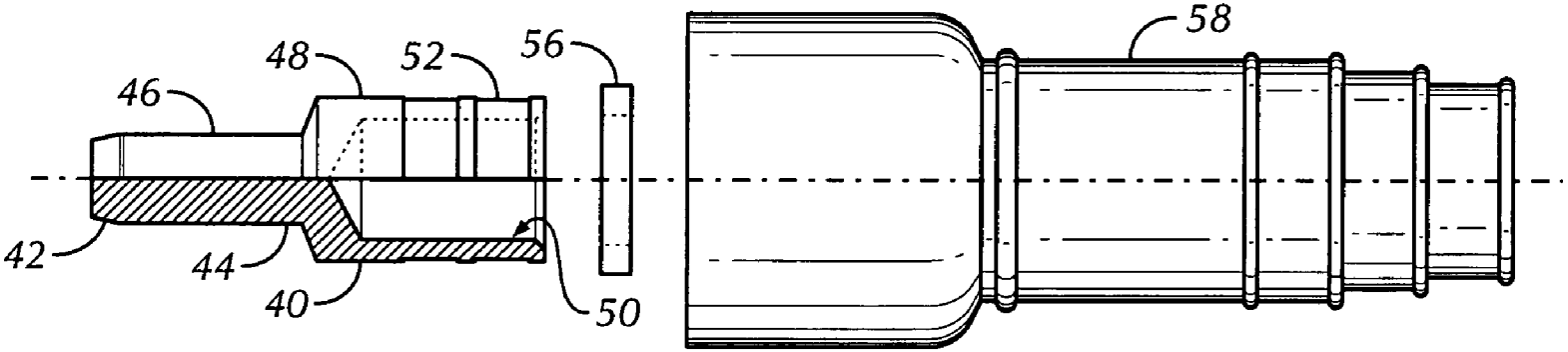
FIG. 2 is a side view of a pin and insulating boot of a preferred embodiment of a single pole electrical connector according to the present invention.

The two primary components of the present invention are illustrated in FIGS. 1B and 2. FIG. 1A shows a single pole electrical connector 10 in cross-sectional view. As shown in FIG. 1B, the connector 10 has a base electrical connection 12. In a preferred embodiment, the base electrical connection 12 is a bus bar type of connection, as is illustrated in FIG. 1B. A threaded shaft connection also may be used, but the bus bar configuration is preferred.

The connector 10 also has a nonconductive mounting base 14, which is shown in side view in FIG. 1B and in cross-section view in FIG. 1A. The base 14 shown is generally square and is substantially larger than the mounting hole that must be bored in the distribution panel. Because the mounting base 14 is made of an electrically nonconductive material, the distribution panel need not be made of a nonconductive material. The panel may be made of steel or some other metallic material, which provides strength and may have other advantages over the melamine and fiberglass boards in wide use today. The nonconductive mounting base 14 is the only part of the connector 10 in contact with the panel, in the preferred embodiment.

As shown in FIG. 1A, the nonconductive mounting base 14 has a generally cylindrical panel insert 16 and a generally square mounting flange 18. Both of these parts are made of nonconductive material. The panel insert 16 fits snugly into a hole bored into a distribution panel. The flange 18, then presses against the panel. A panel gasket 20 (as shown in FIG. 1B) may be positioned over the panel insert 16 and up against the flange 18. When the connector 10 is secured to the panel, the gasket 20 would create a seal between the flange 18 and the panel, thus preventing moisture from getting past the panel. In a preferred embodiment of the present invention, the generally cylindrical panel insert 16 has an outer diameter of approximately 3.5 inches and the generally square mounting flange 18 has an outer side length of approximately 4.5 inches. The mounting flange 18 need not be square, as a circular, rectangular, or other shape would also work.

Figure 3:
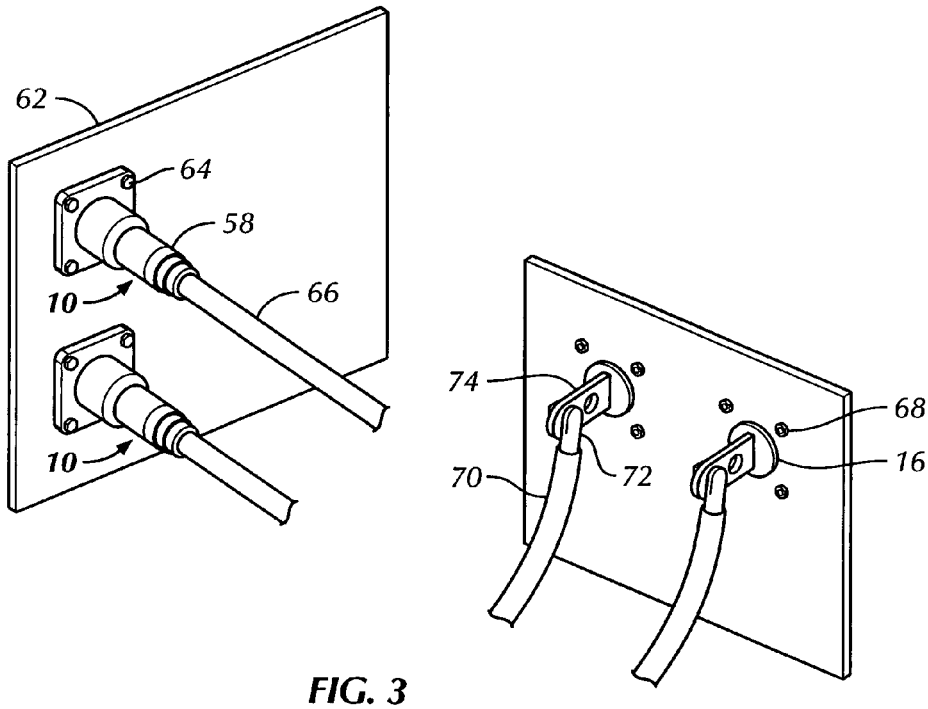
FIG. 3 is a perspective view of a distribution panel showing a pair of installed single pole electrical connectors according to the present invention.

A series of mounting holes 22 are shown in the mounting flange 18. To install the connector 10, a hole is bored into the distribution panel, and the generally cylindrical panel insert 16 is placed inside this hole. Additional, smaller holes are drilled into the panel to align with the mounting holes 22. Bolts are then placed through the mounting holes 22 and the aligned holes in the distribution panel, and nuts are secured to the bolts to securely attached the connector 10 to the distribution panel. FIG. 3 shows a connector 10 according to the present invention attached to a distribution panel. The connections shown in FIG. 3 are described in more detail below.

The connector 10, as shown in FIG. 1B, also has a boot collar 24, a collet 26, and a collet nut 28. The collet has threads 30 for receiving the collet nut 28. In use, the boot collar 24 provides an attachment point of an insulating boot or cover. An illustrative insulating boot 58 is shown in FIG. 2, and will be discussed more below.

The collet 26 shown in FIG. 1B may be of composite construction, with different materials forming the outer threaded surface 34 and the inner surface 32. When connectors of this general type are used, there is a tendency among operators to apply a very large torque to the collet nut 28 in order to achieve the best possible mechanical connection between the collet 26 and the pin 40 (see FIG. 2). Because this is an electrical connector, it is important to provide a highly electrically conductive connection between the pin and collet. Copper is often used because it provides good electrical conductivity.

Copper, however, is not a highly wear-resistant metal. When the collet 26 is made of copper, the outer threaded portion 34 may not provide adequate wear resistance. In other words, if the threaded part of the collet 26 is made of copper, an oilfield worker may strip the threads if a large amount of torque is applied to the collet nut 28. To avoid this problem, a composite collet may be used. Copper, a copper alloy, or some other highly conductive material may be used for the inner surface 32 of the collet 26, while steel or some other wear resistant material (e.g., ceramic, polymer, or high-temperature and high-strength plastic materials may be suitable for this use) may be used for the outer threaded part of the collet 34.

FIG. 2 shows the pin 40 and insulating boot 58 of the present invention. The pin 40 has a conductive pin 46 and a larger crimping section 48. An electrical cable cavity 50 is provided within the pin 40. A boot retaining ring 56 is also shown in FIG. 2. In use, the insulation is stripped from an end of an electrical cable, and the insulating boot 58 then is slid onto the cable. The boot 58 will slide over the insulated cable, so it is moved well back out of the way prior to completion of the rest of the installation. Next, the boot retaining ring 56 is placed over the bare conductor and pushed back up against the cable insulation. The ring 56 has in inside diameter which is slightly larger than the outside diameter of the cable conductor (i.e., with the insulating layer removed), but smaller than the outside diameter of the insulated cable. The ring 56, therefore, will slide over the conductor without much side-to-side motion. The outside diameter of the retaining ring 56 is larger than the insulated cable. Once the retaining ring 56 is in place, the cable conductor is placed inside the electrical cable cavity 50. The larger crimping section 48 contains crimping grooves 52 which are crimped down onto the cable conductor. When this connection is made up, the retaining ring 56 is held in place by the crimped-on pin 40. The insulating boot 58 cannot pull off the cable because the outside diameter of the retaining ring 56 is larger than the inside diameter of the smaller end of the boot 58. In this way, the retaining ring 56 prevents loss of the boot 58.

The pin 40 may be made of a standard size, such that all pins for a particular job are of the same size. Alternatively, the pin 40 may be made in two different sizes, so that polarized connections may be made. In a preferred embodiment, a standard pin 40 would have a conductive pin 46 with an outside diameter of 0.750 inches, and a polarized version of the pin 40 would have a conductive pin with an outside diameter of 0.780 inches. This size difference is sufficient to prevent insertion of a polarized pin into a standard collet. If, on the other hand, a standard pin is inserted into a polarized collet, the connection will not become secure even if the collet nut is fully tightened. In this manner, the use of the polarized connectors ensures that only a polarized pin will be used with a polarized collet, and that only a standard pin will be used with a standard collet. The desirability of polarized connections will depend upon the circumstances of a particular job.

To help distinguish between a polarized and standard pin in the field, the polarized pin may have a partially knurled surface that is easily recognized visually and by feel. The same distinctive characteristic could be achieved by applying knurling to standard pins and not to polarized pins, but it is preferable to use the knurled surface only on the polarized pins. It is expected that standard pins will be used more often, and the knurled surface will be more unusual, and thus, more likely to be noticed by workers in the field, if this feature is reserved for only the polarized pins. The knurled surface is not shown in FIG. 2, but the technique is well known in the art.

Any type of knurling or other surface irregularity may be used to create the distinctive characteristic described herein.

The insulating boot 58 shown in FIG. 2 is made to slide over the entire collet side of a connector 10 after the collet 26 and pin 40 are securely connected together. The boot collar 24 found on the nonconductive mounting base 14 (shown in FIG. 1B) is sized to match the inside diameter of the larger end of the insulating boot 58. In use, the boot 58 slides snugly over the boot collar 24, thus producing a reliable and insulating cover for one side of the electrical connector.

FIG. 3 shows an electrical distribution panel 62 from both sides. Two fully made up connectors according to the present invention are shown. The connector 10 is attached to the distribution panel 62 using mounting bolts 64 and mounting nuts 68. An output power line 66 is shown leaving the connector 10 on one side of the panel 62. This side of the connector 10 is covered by the insulating boot 58.

An input power line 70 having a lug connection 72 at its end is shown on the other side of the panel 62. The lug connection 72 is connected to a bus bar 74 on the connector 10. This portion of the assembly is on a secure and closed side of the distribution panel. For this reason, individual insulating boots for each line may not be required. If, however, insulating boots are desired on the input line side, an insulating boot 58 and retaining ring 56 combination may be used just as was described above for the collet and pin side of the connector 10.

Figure 4:
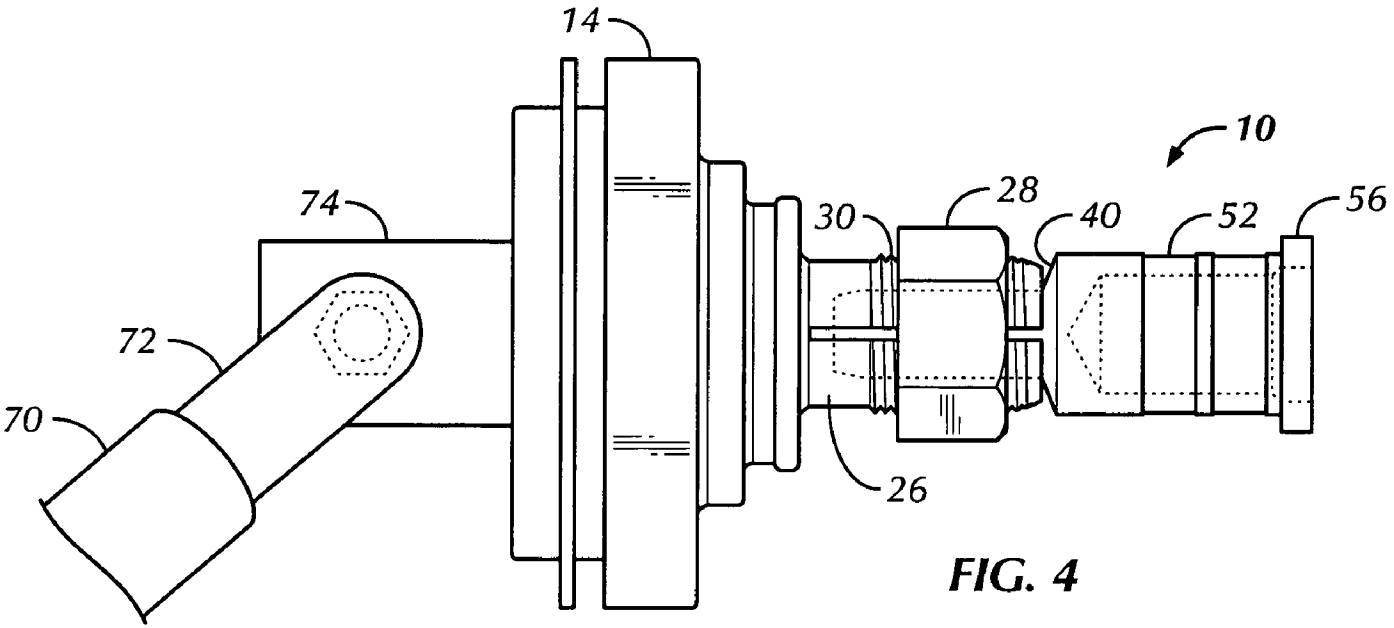
FIG. 4 is a side view of a single pole electrical connector according to the present invention.

FIG. 4 shows a side view of a fully made up connector 10, without an insulating boot 58 and without installation into a distribution panel 62. This configuration is provided for illustration purposes only, as the connector would not be used in this manner in the field. Connections like those illustrated in FIG. 3 are expected to be typical. FIG. 4, however, is helpful to understanding the invention because it shows many parts of the connector in a made-up configuration (the load-side connection is not complete, as there is no load cable shown and the insulating boot 58 is also not shown). An input line 70 with a lug connection 72 are shown connected to a bus bar 74. A pin 40 is inserted into the collet 26, and the collet nut 28 is tightened onto the collet threads 30. This causes the sides of the collet 26 to pinch down on the pin 40, thus forming a mechanical and electrical connection.

To improve this connection, the invention may use an inverse tapered pin 40. In this embodiment, the conductive pin 46 has a larger outside diameter at its distal end 42 than its proximal end 44. To understand this improvement, it is important to realize how the collet 26 works. When the collet nut 28 is tightened, the distal ends of the collet 26 are pinched together. The proximal ends of the collet 26, on the other hand, do not move or move very little. At the extreme proximal end of the collet 26, there can be no movement because the collet 26 is a single piece of metal. Only the portion of the collet 26 with the slots cut along its length can be pinched together.

This characteristic of the collet 26 results in the distal end of the collet having a smaller inside diameter than the proximal end of the collet 26 when the collet nut 28 is tightened. The inside surface of the collet 26, therefore, has a taper when the collet nut 28 is tightened. By creating an inverse taper along the length of the conductive pin 46, a better matching of the pin's outer surface to the collet's inner surface is obtained. An inverse tapered conductive pin 46 has a smaller outside diameter at its proximal end 44, which is matched to the smaller inside diameter of the collet's distal end. The pin's distal end 42, on the other hand, is better matched to the larger diameter of the collet's proximal end.

The use of a conductive pin 46 with an inverse taper provides a better mechanical and electrical connection. By improving the mechanical connection, the pin is less prone to pull out of the collet. By created greater surface contact between the conductive pin 46 and collet 26, the electrical resistance of the connection is reduced, and thus, less heat is generated in use. This reduces electrical losses and results in less heat deformation of the insulating boot 58. In prior art connectors, as the connection becomes hot, the insulating boot 58 becomes increasingly soft. At a certain point, the boot 58 may become so soft that it no longer remains securely attached to the connector, and thus slides out of place. The improved connection helps reduce this risk.

Figure 5:
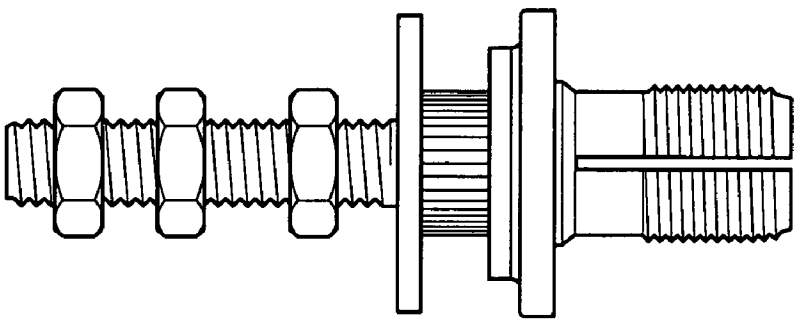
FIG. 5 (Prior Art)
FIG. 5 is a side view of a single pole electrical connector of the prior art.

The present invention also may embody color coding to help workers in the field recognize and distinguish different connections. The nonconductive mounting base 14 is considerably larger than the body of prior art single pole connectors (compare, for example, FIGS. 1A and 1B with FIG. 5). By color coding the base 14, workers can readily see the colored components. The base 14 is larger than the area covered by the insulating boot, so a color coded mounting base 14 will remain visible even when an insulating boot is in place over the collet and pin portion of the connector. To further enhance the color coding benefits, the insulating boots also may be color coded to match the mounting bases. This configuration provides a highly visible color coding scheme.

The present invention may be constructed so that the conductive portions of the connector 10 are removable from the mounting base 14 in the field. The conductive parts of the connector 10 may be attached to the mounting base 14 using a locking ring that can be removed and reinstalled in the field. This would allow the mounting base 14 to remain in place if, for example, the collet threads become stripped or damaged. The internal parts of the connector could be changed out, leaving the mounting base 14 securely attached to the distribution panel. This capability would allow for relatively easy field replacement of key parts of the connector, and could reduce the need for spare parts.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

I claim:

1. A single pole electrical connector comprising, a) a base electrical connection;

b) a nonconductive mounting base connected to the base electrical connection;

c) a conductive, threaded collet connected to the nonconductive mounting base and the base electrical connection;

d) a collet nut; and, e) a conductive pin configured to fit within the collet such that when the collet nut is tightened, the collet will tighten onto the pin, resulting in a secure electrical and mechanical connection between the pin and collet.

2. The connector of claim 1, wherein the conductive pin has an inverse tapered outer surface.

3. The connector of claim 1, wherein the base electrical connection is a bus bar connection.

4. The connector of claim 1, wherein the base electrical connection and conductive collet are field-removable from the nonconductive mounting base.

5. The connector of claim 1, wherein the nonconductive mounting base is color coded.

6. The connector of claim 1, wherein the pin has a knurled outer base surface.

7. The connector of claim 1, wherein the collet further comprises a composite material having a first conductive material positioned on an inner surface of the collet and a second material positioned on an outer, threaded surface of the collet.

8. The connector of claim 7, wherein the second material is more wear resistant than the first conductive material.

9. The connector of claim 7, wherein the second conductive material is steel or a steel alloy.

10. The connector of claim 7, wherein the first conductive material is copper or a copper alloy.

11. The connector of claim 10, wherein the second conductive material is steel or a steel alloy.

12. The connector of claim 1, further comprising a) an insulating boot configured to be positioned around the collet and pin when the pin is secured within the collet; and, b) an insulating boot retaining ring.

13. The connector of claim 12, wherein the insulating boot is color coded.

14. The connector of claim 12, wherein the nonconductive mounting base is color-coded and is large enough that an outer portion of the color-coded base remains visible when the insulating boot is positioned around the collet and pin.

15. The connector of claim 1, wherein the nonconductive mounting base further comprises, a) a generally cylindrical panel insert; and, b) a mounting flange having larger outer dimensions than the generally cylindrical panel insert.

16. The connector of claim 15, wherein the generally cylindrical panel insert has a diameter of approximately 3.5 inches and the mounting flange is generally square with a side length of approximately 4.5 inches.

17. A single pole electrical connector comprising, a) a nonconductive mounting flange having a generally cylindrical inner opening;

b) a base electrical connection securely attached within the generally cylindrical inner opening of the nonconductive mounting flange;

c) a conductive, threaded collet connected to the base electrical connection;

d) a collet nut; and, e) a conductive pin configured to fit within the collet such that when the collet nut is tightened, the collet will tighten onto the pin, resulting in a secure electrical and mechanical connection between the pin and collet.

18. The connector of claim 17, wherein the conductive pin has an inverse tapered outer surface.

19. The connector of claim 17, wherein the base electrical connection is a bus bar connection.

20. A single pole electrical connector comprising, a) a base electrical connection;

b) a panel mounting base having a nonconductive mounting flange and a generally cylindrical inner opening, wherein the base electrical connection is securely attached within the generally cylindrical inner opening of the nonconductive mounting flange;

c) a conductive, threaded collet connected to the base electrical connection;

d) a collet nut; and, e) an inverse tapered conductive pin configured to fit within the collet such that when the collet nut is tightened, the collet will tighten onto the pin, resulting in a secure electrical and mechanical connection between the pin and collet.

* * * * *